US006676574B1

(12) United States Patent
Prokop et al.

(10) Patent No.: US 6,676,574 B1
(45) Date of Patent: Jan. 13, 2004

(54) SHIFT POSITION SELECTOR FOR A PAD ON AN EXERCISE MACHINE

(75) Inventors: Denise L. Prokop, Los Osos, CA (US); Jeff McCalley, Paso Robles, CA (US)

(73) Assignee: Brunswick Corporation, Franklin Park, IL (US)

( * ) Notice: Subject to any disclaimer, the term of this patent is extended or adjusted under 35 U.S.C. 154(b) by 286 days.

(21) Appl. No.: 10/029,634

(22) Filed: Oct. 25, 2001

(51) Int. Cl.[7] ..... A63B 21/062
(52) U.S. Cl. ..... 482/100; 482/137; 482/908
(58) Field of Search ..... 482/100, 908, 482/134–139

(56) References Cited

U.S. PATENT DOCUMENTS 4,407,496 A * 10/1983 Johnson ..... 482/97
4,411,424 A * 10/1983 Barnett ..... 482/99
4,678,185 A * 7/1987 Mahnke ..... 482/137
4,776,587 A * 10/1988 Carlson et al. ..... 482/5
4,842,271 A * 6/1989 Vinciguerra ..... 482/100
5,020,797 A * 6/1991 Burns ..... 482/139
5,031,905 A * 7/1991 Walsh ..... 482/112
5,102,121 A * 4/1992 Solow et al. ..... 482/94
5,356,360 A * 10/1994 Johns ..... 482/99
5,605,523 A * 2/1997 Ish et al. ..... 482/99
5,616,107 A * 4/1997 Simonson ..... 482/97
5,624,353 A * 4/1997 Naidus ..... 482/5
5,672,143 A * 9/1997 Ish, III ..... 482/99
5,695,433 A * 12/1997 Buisman ..... 482/70
5,722,921 A * 3/1998 Simonson ..... 482/100
5,762,585 A * 6/1998 Jones et al. ..... 482/8
5,779,601 A * 7/1998 Ish, III ..... 482/100
5,961,428 A * 10/1999 Webber ..... 482/100
5,961,429 A * 10/1999 Hsu ..... 482/142
5,980,434 A * 11/1999 Webber ..... 482/100
6,354,982 B1 * 3/2002 Sencil ..... 482/96
6,558,303 B1 * 5/2003 Ellis ..... 482/138

* cited by examiner

*Primary Examiner*—Nicholas D. Lucchesi
*Assistant Examiner*—Victor Hwang
(74) *Attorney, Agent, or Firm*—Mayer, Brown, Rowe & Maw LLP.

(57) ABSTRACT

An adjustment system for positioning a pad on a user arm for an exercise machine is disclosed. The user arm is coupled to a rotating cam which is attached to one end of a cable. The other end of the cable is attached to a weight system which pulls the rotating cam to bias the user arm in one position. The adjustment system has a selector hub mounted on one end of the user arm. The selector hub has an arcuate surface having a plurality of holes. A pull pin assembly is rotatably positioned around the selector hub. The pull pin assembly includes a pin which may be inserted in the plurality of holes to lock the pin assembly in a fixed position. A linkage bar has one end pivotably mounted to the pull pin assembly and an opposite end pivotably attached to one end of a support linkage bar. The support linkage bar is rotatably mounted on the user arm. The opposite end of the support linkage bar is coupled to a perpendicular rod with a pad. The perpendicular rod and pad are fixed in position relative to the user arm when the pin is inserted in one of the plurality of holes.

20 Claims, 7 Drawing Sheets

SHIFT POSITION SELECTOR FOR A PAD ON AN EXERCISE MACHINE

FIELD OF INVENTION

This invention relates to an adjustment mechanism for the location of a pad relative to a user arm for an exercise machine.

BACKGROUND OF INVENTION

Exercise machines such as weight machines, leg extender and press machines and seated curl machines are well known. Such machines allow a user to condition various parts of his or her body by working to lift, pull or push a user arm that is tensioned by weighted bars. The repetitive motion of lifting, pushing or pulling weights builds up muscles in the particular part of the body. In order to be useful for a wide variety of physiques, exercise machines require adjustable parts for fit to different users. Such adjustments are necessary not only to maximize the effectiveness of the machine but also for insuring proper functioning because contact with the tensioning surface with the proper body part is required for operation.

Typically the user arms on exercise machines include telescoping rods or bars with a series of holes that hold pads for contact with a user's body. The user adjusts the length of such rods and bars by extending or retracting them to the desired length and locking the two pieces with a pin through the holes. Alternatively, a screw type clamp may be used to lock the two pieces together at the desired length. Such a method is effective, however, a user must make such adjustments before using the machine. Thus, errors may result because a user must estimate the desired lengths before actually taking the exercise position in the machine.

One example of such an adjustable component is the ankle roller for a leg extension machine. This machine is used to strengthen a user's leg muscles by having his or her legs work in raising a weight coupled to the user arm via a cable. The end of the arm has a padded cylindrical pad which is placed on a user's ankles to provide secure contact to the user arm. The cylindrical pad is on an extendable bar attached on the user arm which is adjusted to a user's leg length. Currently, the user arm has two telescoping pieces, one of which is attached to the pad. The pad is put in its desired position and a screw type clamp is tightened to lock the pad at the desired length on the user arm. As explained above, this prevents a user from making the adjustments while sitting in the machine because the user cannot adjust the pad when sitting in the machine.

Thus, there is a need for a selector for an adjustable linkage which allows adjustment of a pad relative to a user arm while a user is operating exercise equipment. There is a further need for a mechanically simple means to operate an adjustable linkage for positioning a pad in an exercise machine. There is also a need for a adjustable pad relative to a user arm which may be used in any variety of exercise machines.

SUMMARY OF THE INVENTION

These needs and others may be met by the present invention which has an aspect which is an adjustment mechanism for use with a user arm in an exercise machine. The user arm is designed to strengthen the muscle of a user by moving the user arm. The adjustment mechanism has a selector hub mounted on one end of the user arm. A selector is rotatably connected to the selector hub. The selector is capable of being locked in position relative to the selector hub. A linkage bar has one end pivotably mounted to the selector. A support linkage bar is rotatably mounted to the opposite end of the user arm. The support linkage bar has one end rotatably coupled to the opposite end of the linkage bar. A perpendicular rod is coupled to the opposite end of the support linkage bar. The perpendicular rod is fixed in position relative to the user arm when the selector is locked in position relative to the selector hub.

Another aspect of the present invention may be found in an exercise machine for conditioning a user's muscles. The exercise machine has a frame providing a stable support for a user's body. A user arm is moveably coupled to the frame. A cable having one end coupled to the user arm is provided. A weight system is coupled to the opposite end of the cable such that moving the user arm causes the weight system to move. A selector hub is mounted on the user arm. A selector mechanism is rotatably positionable about the selector hub. The selector is capable of being locked in a position relative to the selector hub. A linkage bar has one end pivotably mounted to the selector mechanism. A support linkage bar is rotatably mounted to the opposite end of the user arm. The support linkage bar has one end rotatably coupled to the opposite end of the linkage bar. A perpendicular rod is coupled to the opposite end of the support linkage bar, the perpendicular rod being fixed in position relative to the user arm when the selector mechanism is locked in a position relative to the selector hub.

Another aspect of the present invention may be found in an exercise machine for conditioning a user's muscles. The machine has a frame providing a stable support for a user's body. A rotatable cam is coupled to the frame. A cable has one end connected to the rotatable cam and guided over a pulley mounted on the frame. The cable has an opposite end coupled to a weight system. The weight system tensions the rotatable cam in one position. A user arm has one end coupled to the rotatable cam. A selector hub is mounted on the user arm. The selector hub has an arcuate surface having a plurality of holes. A pull pin assembly is rotatably positioned around the selector hub. The pull pin assembly includes a pin which may be inserted in the plurality of holes to lock the pin assembly in a fixed position. A linkage bar has one end pivotably mounted to the pull pin assembly. A support linkage bar is rotatably mounted to the opposite end of the user arm. The support linkage bar has one end rotatably coupled to the opposite end of the linkage bar. A perpendicular rod is coupled to the opposite end of the support linkage bar. The perpendicular rod is fixed in position relative to the user arm when the pin is inserted in one of the plurality of holes.

It is to be understood that both the foregoing general description and the following detailed description are not limiting but are intended to provide further explanation of the invention claimed. The accompanying drawings, which are incorporated in and constitute part of this specification, are included to illustrate and provide a further understanding of the method and system of the invention. Together with the description, the drawings serve to explain the principles of the invention.

BRIEF DESCRIPTION OF DRAWINGS

These and further aspects and advantages of the invention will be discussed more in detail hereinafter with reference to the disclosure of preferred embodiments, and in particular with reference to the appended Figures that illustrate.

DESCRIPTION OF THE PREFERRED EMBODIMENT

Figure 1:
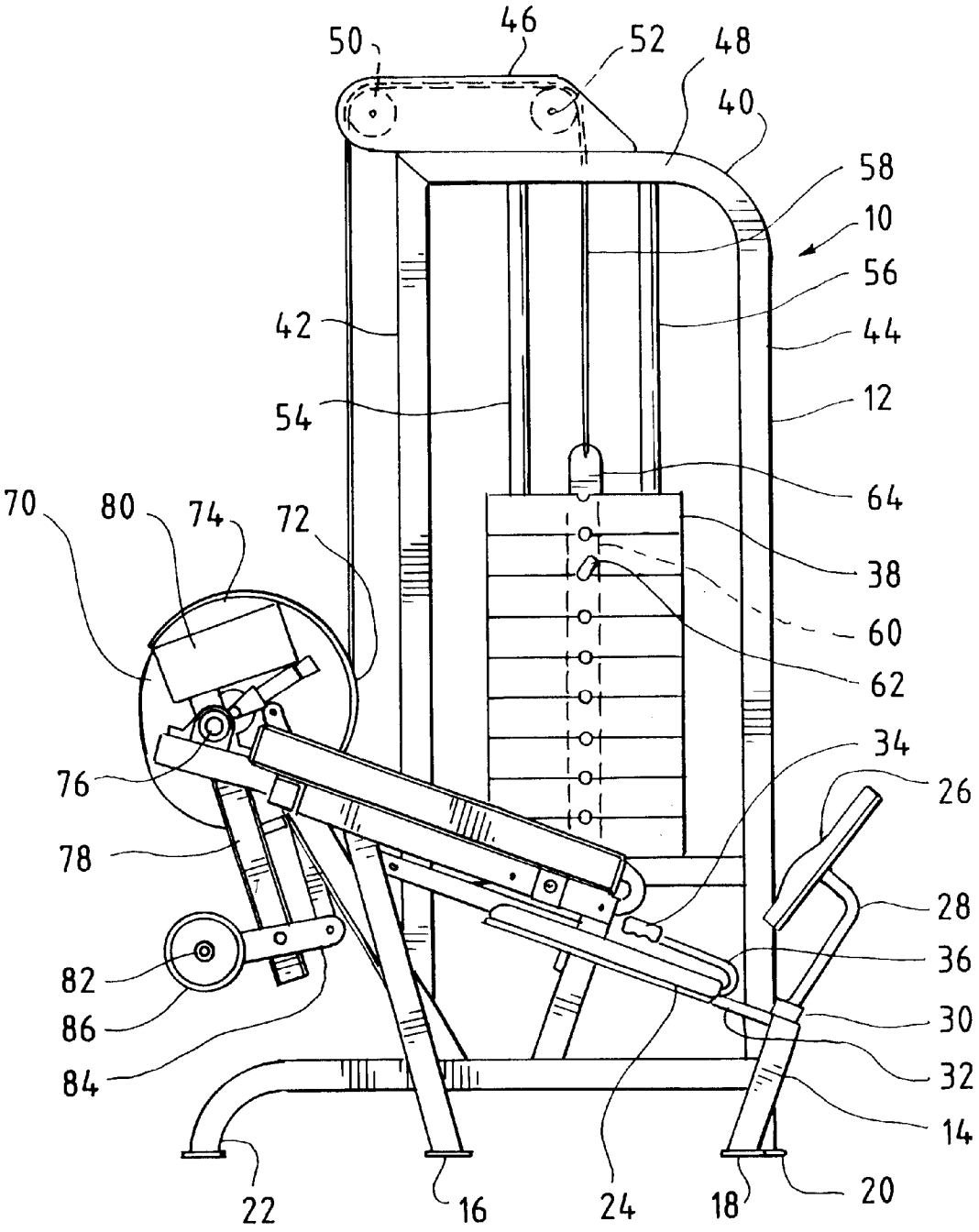
FIG. 1 is a perspective view of a leg extension machine using an embodiment of the present invention with the user arm and ankle pad held in a down position by the weights.

While the present invention is capable of embodiment in various forms, there is shown in the drawings and will hereinafter be described a presently preferred embodiment with the understanding that the present disclosure is to be considered as an exemplification of the invention, and is not intended to limit the invention to the specific embodiment illustrated.

FIG. 1 is a side view of an exercise machine 10 which uses an example of the present invention. In this example, the exercise machine 10 is a leg extension machine which is designed to strengthen quadracep and shin muscles. The exercise machine 10 has a rigid frame 12. The frame 12 has a mounting stand 14 with four legs 16, 18, 20 and 22 which provides stable support for a user's body when using the exercise machine 10.

A spring loaded seat 24 is attached at an angle to the mounting stand 14. A lumbar pad 26 is provided to support a user's back. The lumbar pad 26 is mounted on one end of an arm 28. The other end of the arm 28 is attached to a socket 30. The socket 30 may be moved on an angled bar 32. The location of the lumbar pad 26 relative to the seat 24 may thus be adjusted by moving the socket 30 along the angled bar 32. The socket 30 may be locked in place by a pin (not shown). An additional handle 34 is mounted on an extension rod 36 to provide a grip for a user's hands during use of the machine 10.

A series of weights 38 are suspended by a vertical frame 40. The weights 38 are typically identical metal bars having a desired incremental weight. The vertical frame 40 has two vertical supports 42 and 44. A pulley guard 46 is mounted on a horizontal support 48 joining the top of the two vertical supports 42 and 44. The pulley guard 46 houses two pulleys 50 and 52. The horizontal support 48 suspends two vertical guide rods 54 and 56. The weights 38 each have holes which allow them to be moved vertically on the guide rods 54 and 56. A cable 58 also is suspended from the pulley guard 46 and between the vertical guide rods 54 and 56. The weights 38 also have a middle hole which allows a weight selector rod 60, which is located between the vertical guide rods 54 and 56 to move freely. The weight selector rod 60 has a series of holes (not shown) which allow a locking pin 62 to be inserted either between the weights 38 or through one of the weights depending on the location of a matching hole on the weights 38. In this manner, a user may select the number of weights 38 which are lifted by the cable 58. One end of the weight selector rod 60 is attached to a cable termination fitting 64 which is connected to the top weight of the weights 38. One end of the cable 58 is attached to the cable termination fitting 64. The cable 58 is tensioned by the weights 38. The cable 58 is guided by the pulleys 50 and 52 through the pulley guard 46.

The other end of the cable 58 is attached to a rotating cam 70. The cam 70 has a groove 72 to guide the cable 58 and a side surface 74. The cam 70 rotates on an axle 76 which is mounted on the frame 12. A user arm 78 is extended from the cam 70 and has one end attached to the side surface 74. A counterweight 80 is placed on the side surface 74 diametrically from the user arm 78. The counterweight 80 serves to negate the weight of the user arm 78 such that the only weight lifted by the user moving the user arm 78 is the selected weights 38. The user arm 78 has an opposite end which is attached to a perpendicular rod 82 via a position selector mechanism 84. A cylindrical ankle pad 86 is mounted on the perpendicular rod 82. The cylindrical ankle pad 86 is typically made of a soft, resilient material such as closed cell foam covered with upholstery to provide a contact surface in order to cushion a user's ankles from the strain of pushing against the pad 86. The location of the cylindrical ankle pad 86 relative to the user arm 78 may be adjusted by the position selector mechanism 84 which embodies the principles of the present invention.

Figure 2:
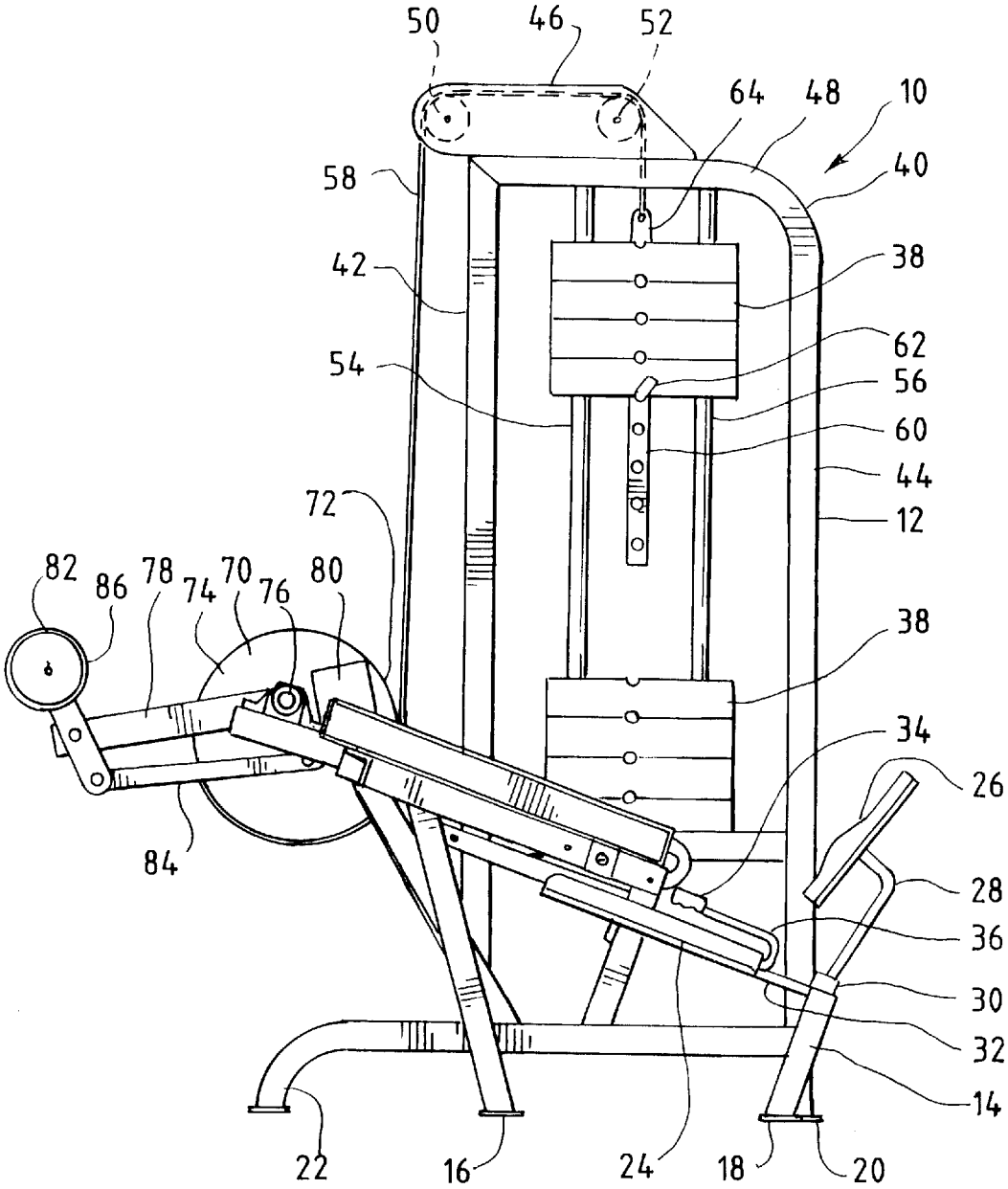
FIG. 2 is a perspective view of the leg extension machine in FIG. 1 with the user arm and ankle pad in an up position lifting the weights.

In practice, the user sits in the seat 24 and leans his or her back against the lumbar pad 26. The user then selects the amount of weight he or she wishes to lift by placing the pin 62 below or through one of the weights 38. The user will hold the handle 34 to further steady his or her upper body. The user places his or her legs so that his or her ankles push against the ankle pad 86. After adjusting the location of the pad 86 via the position selector mechanism 84, the user uses his or her legs and moves the pad 86 and the user arm 78 from the down position shown in FIG. 1 to the up position shown in FIG. 2. In this manner, when the user arm 78 is moved to the up position by the user, the cam 70 rotates. The rotation of the cam 70 pulls the cable 58 which in turn pulls the weights 38 above the pin 60 up on the guide rods 54 and 56. Normally, the weights 38 tension the cable 58 and thus the cam 70 is rotated such that the user arm 78 is in the down position as shown in FIG. 1.

Figure 3:
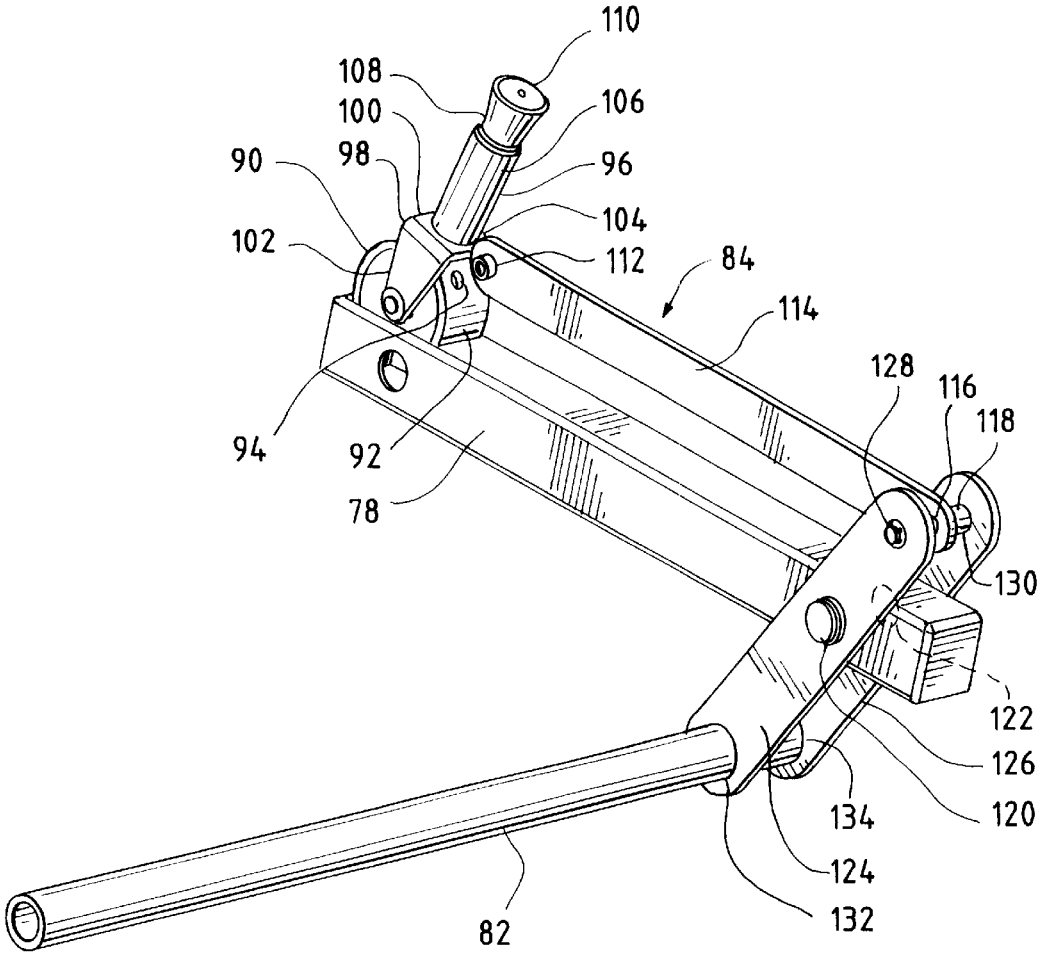
FIG. 3 is a close up view of the selector mechanism for the user arm and ankle pad shown in FIG. 1.

FIG. 3 is a close up perspective view of the position selector mechanism 84 shown in FIG. 1. The position selector mechanism 84 has a cylindrical selector hub 90 which is mounted on top of the user arm 78. The selector hub 90 has an arcuate exterior surface 92 with a series of holes 94 at periodic intervals. A pull pin assembly 96 is rotatably mounted on the selector hub 90. The pull pin assembly 96 has a fork 98 which has a top plate 100 with a pair of laterally extending arms 102 and 104. The arms 102 and 104 have holes which are attached to a pin in the center of the selector hub 90. The arms 102 and 104 thus rotate around the selector hub 90. A cylindrical tube 106 is mounted on the top plate 100. A selector pin 108 is telescopically spring loaded within the cylindrical tube 106. One end of the selector pin 108 has a knob 110 which may be gripped by the user to rotate the selector pin 108 and thereby the fork 98 relative to the selector hub 90. The opposite end of the selector pin 108 may be inserted in any of the holes 94 to lock the fork 98 and selector pin 108 in one position relative to the selector hub 90.

The fork 98 has a pivot 112 which is coupled to one end of a linkage bar 114. The linkage bar 114 thus is positioned by moving the fork 98 relative to the selector hub 90. The other end of the linkage bar 114 has a hole 116 through which a pin 118 is inserted. The user arm 78 has a pair of pivot hinges 120 and 122 which rotatably mount a pair of support linkages 124 and 126. One end of the support linkages 124 and 126 have holes 128 and 130 respectively which allow them to pivot about the pin 118. A pair of e-rings hold the support linkages 124 and 126 on the ends of the pin 118. The opposite end of the support linkages 124 and 126 have holes 132 and 134 through which the perpendicular rod 82 is inserted. The components of the position selector mechanism 84 are preferably steel although any sturdy and rigid material may be used.

Figure 4:
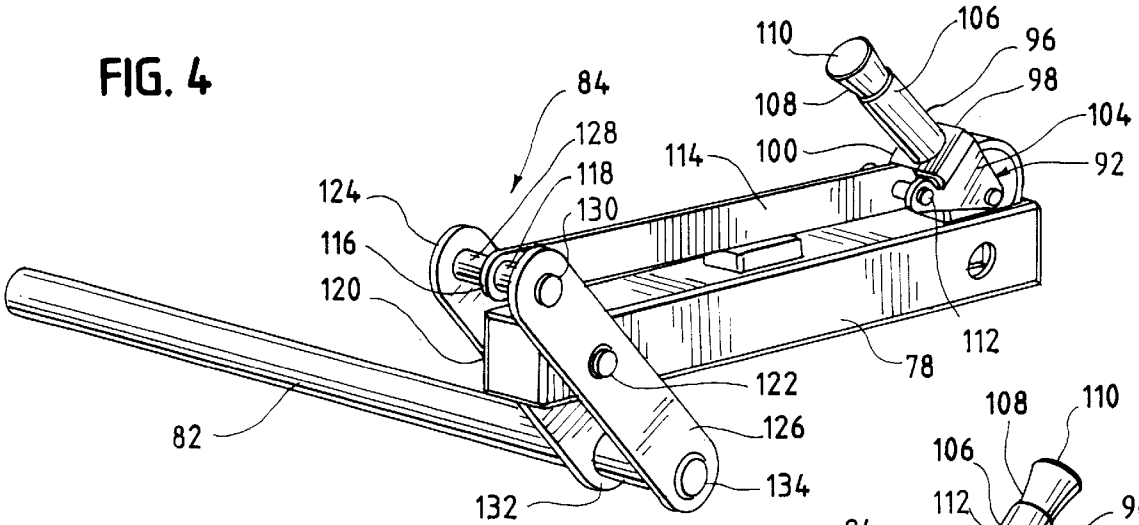
FIG. 4 is a close up view of the selector mechanism shown in FIG. 1 with the ankle pad locked in the fully retracted position.
Figure 5:
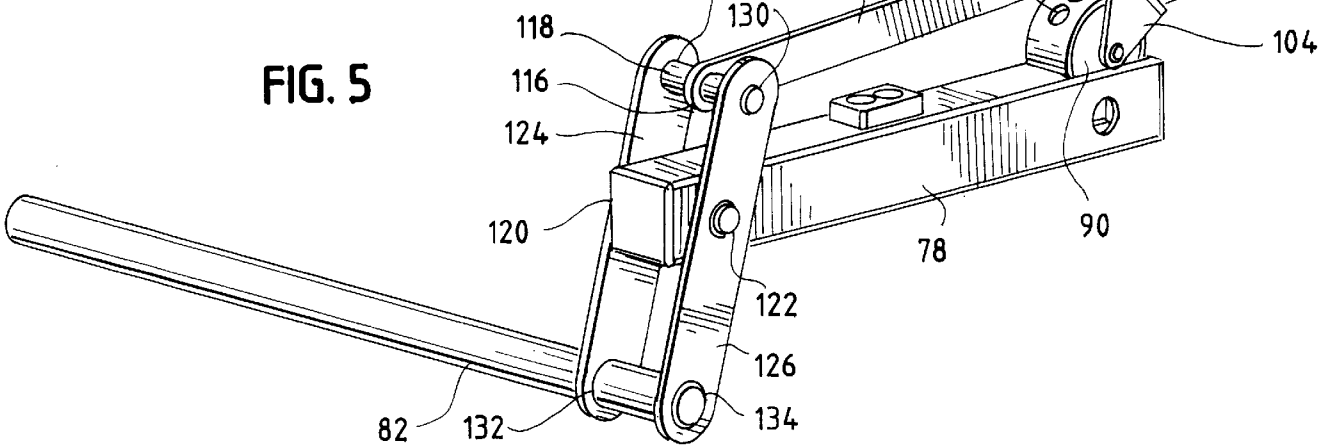
FIG. 5 is a close up view of the selector mechanism shown in FIG. 1 with the pad locked in the fully extended position.

The user may thus adjust the location of the ankle pad 86 in order to tailor it to his or her leg length by using the selector mechanism 84. The user pulls the knob 110 to retract the selector pin 108 from the selector hub 90 and rotate the selector pin 108. As shown in FIG. 4, for a user with relatively shorter legs, the user would move the knob 110 and thus rotate the selector pin 108 and fork 98 forward. This pushes the linkage bar 114 forward causing the support linkages 124 and 126 to pivot on the user arm 78, causing the perpendicular rod 82 and ankle pad 86 to be moved closer to the selector hub 90. As shown in FIG. 5, if the user had longer legs, he or she would move the knob 110 backwards and thus rotate the selector pin 108 and the fork 98 backward. This pulls the linkage bar 114 back causing the support linkages 124 and 126 to pivot and move the perpendicular rod 82 and ankle pad 86 away from the selector hub 90. Once a user moves the perpendicular rod 82 and the ankle pad 86 to a comfortable position relative to his or her ankles, he or she pushes the knob 110 down which locks the selector pin 108 in the appropriate hole 94 on the selector hub 90.

Although there are four holes 94 in the selector hub 90, it is to be understood that any number of holes may be made on the selector hub 90 to provide greater or less variety of positions for the pad 86. Furthermore, there can be different mechanisms to lock the selector pin 108 in place relative to the selector hub 90. For example, the selector hub 90 can have a plurality of slots and the selector pin 108 may be replaced with a selector having a moveable plate which may be inserted in one of the plurality of slots to lock the selector in a fixed position. Other devices such as a friction clamp or a screw clamp mechanism may be used rather than the hole and pin arrangement described above in place of the selector pin 108.

Figure 6:
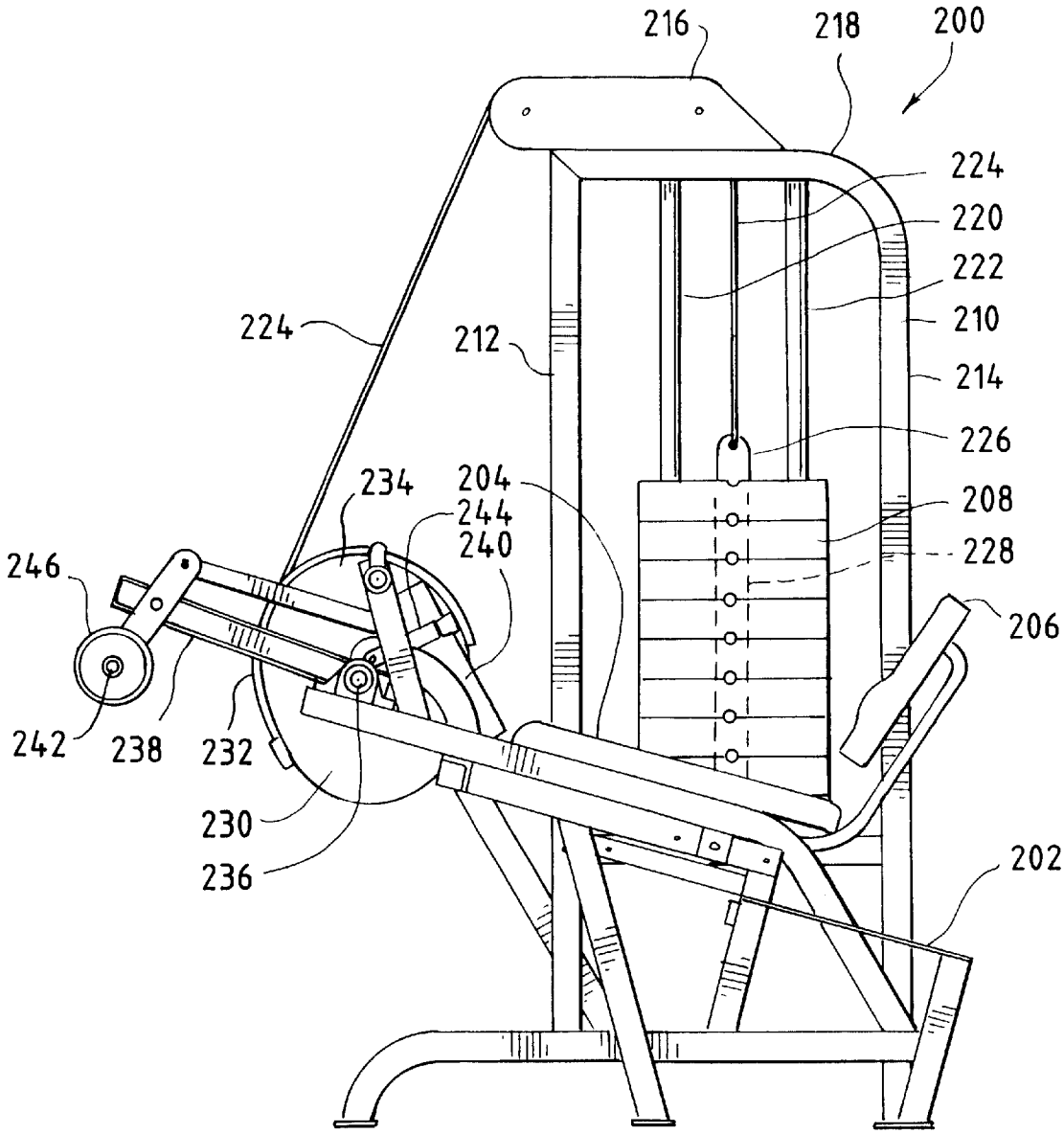
FIG. 6 is a side view of a seated leg curl machine using the selector mechanism of the present invention for a calf pad.

It is also to be understood that the position selector mechanism 84 may be used to adjust any pad in a lateral position while a user is sitting in an exercise machine. Also, the mechanism may be used in a variety of exercise machines and any pad which is used for contact with moving a user arm. For example, FIG. 6 shows a seated leg curl exercise machine 200 which is designed to condition hamstring and calf muscles. The exercise machine 200 has a rigid frame 202 that holds a spring loaded seat 204 which is mounted at an angle. A lumbar pad 206 is provided to support a user's back. A series of weights 208 is suspended by a vertical frame 210. The vertical frame 210 has two vertical supports 212 and 214. A pulley guard 216 is mounted on a horizontal support 218 joining the top of the two vertical supports 212 and 214. The horizontal support 218 suspends two vertical guide rods 220 and 222 on which the weights 208 are inserted and guide the vertical movement of the weights 208. A cable 224 is suspended from the pulley guard 216 and is connected via a cable termination fitting 226 which is attached to a weight selector rod 228. A user may select the number of weights 208 pulled by the cable 224 by inserting a pin between the weights 208 or through one of the weights 208 and into the weight selector rod 228.

The other end of the cable 224 is threaded through the pulley guard 216 and attached to a rotating cam 230. The cam 230 has a groove 232 to guide the cable 220 and a side surface 234. The cam 230 rotates on an axle 236 which is mounted on the frame 202. A user arm 238 is extended from the cam 230 and has one end attached to the side surface 234. A counterweight 240 is placed on the side surface 234 diametrically from the user arm 238.

The user arm 238 has an opposite end which is attached to a perpendicular rod 242 via a position selector mechanism 244. A cylindrical calf pad 246 is mounted on the perpendicular rod 242. The location of the cylindrical calf pad 246 relative to the user arm 238 may be adjusted by the position selector mechanism 244 which is identical to the position selector mechanism 84 shown in FIG. 3.

A user sits in the seat 204 and places his or her legs over the perpendicular rod 242 resting his or her calves on the cylindrical calf pad 246. The user may then adjust the position of the pad 246 using the selector mechanism 244 as explained above. The user pushes down on his or her legs which causes the user arm 238 to rotate the cam 230 thus pulling the weights 208.

Figure 7:
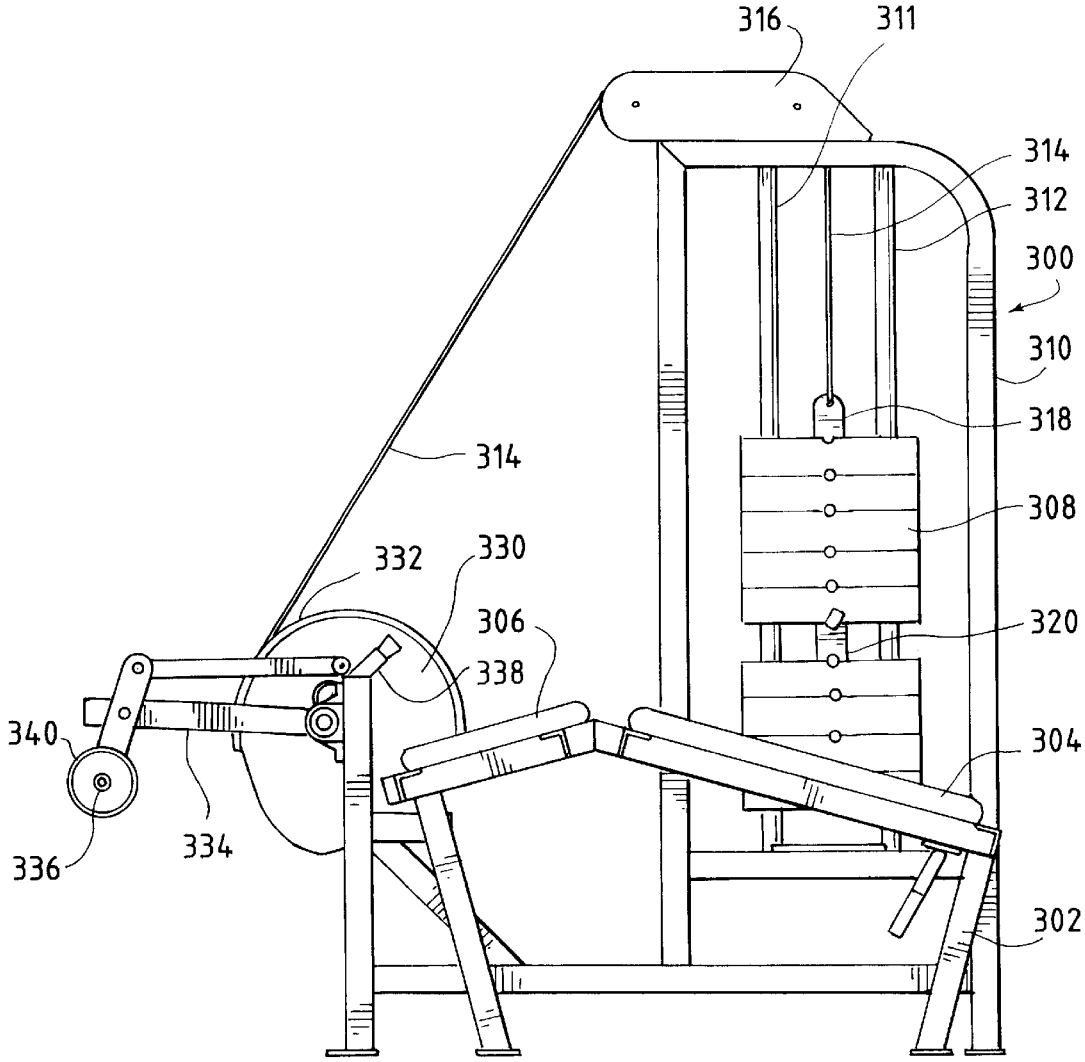
FIG. 7 is a side view of a prone leg curl machine using the selector mechanism of the present invention for a calf pad.

Another example of the application of the present invention is shown in FIG. 7 which shows a side view of a prone leg curl exercise machine 300 which is designed to build up hamstring and calf muscles. The exercise machine 300 has a rigid frame 302 which holds a stomach pad 304 mounted at an angle. A thigh pad 306 is fixed at an angle to the stomach pad 304 to provide further support for the user's lower body. A series of weights 308 is suspended by a vertical frame 310. The weights 308 are threaded on two vertical guide rods 311 and 312. A cable 314 is suspended from a pulley guard 316 and is connected via a cable termination fitting 318 to a weight selector rod 320. A user may select the number of weights 308 which are pulled by the cable 314 by inserting a pin between the weights 308 and into the weight selector rod 320.

The other end of the cable 314 is threaded through the pulley guard 316 and attached to a rotating cam 330. The cam 330 has a groove 332 to guide the cable 314 and is rotated by an attached user arm 334. The user arm 334 is attached to a perpendicular rod 336 via a position selector mechanism 338. A cylindrical calf pad 340 is mounted on the perpendicular rod 336. The location of the cylindrical calf pad 340 relative to the user arm 334 may be adjusted by the position selector mechanism 338 which is identical to the position selector mechanism 84 shown in FIG. 3.

The user adjusts the position of the pad 340 using the selector mechanism 338 as explained above. A user lies on the pads 304 and 306 and places his or her lower legs under the perpendicular rod 336 resting his or her calves on the cylindrical calf pad 340. The user pushes his or her legs which causes the user arm 334 to rotate the cam 330 thus pulling the weights 308.

Figure 8:
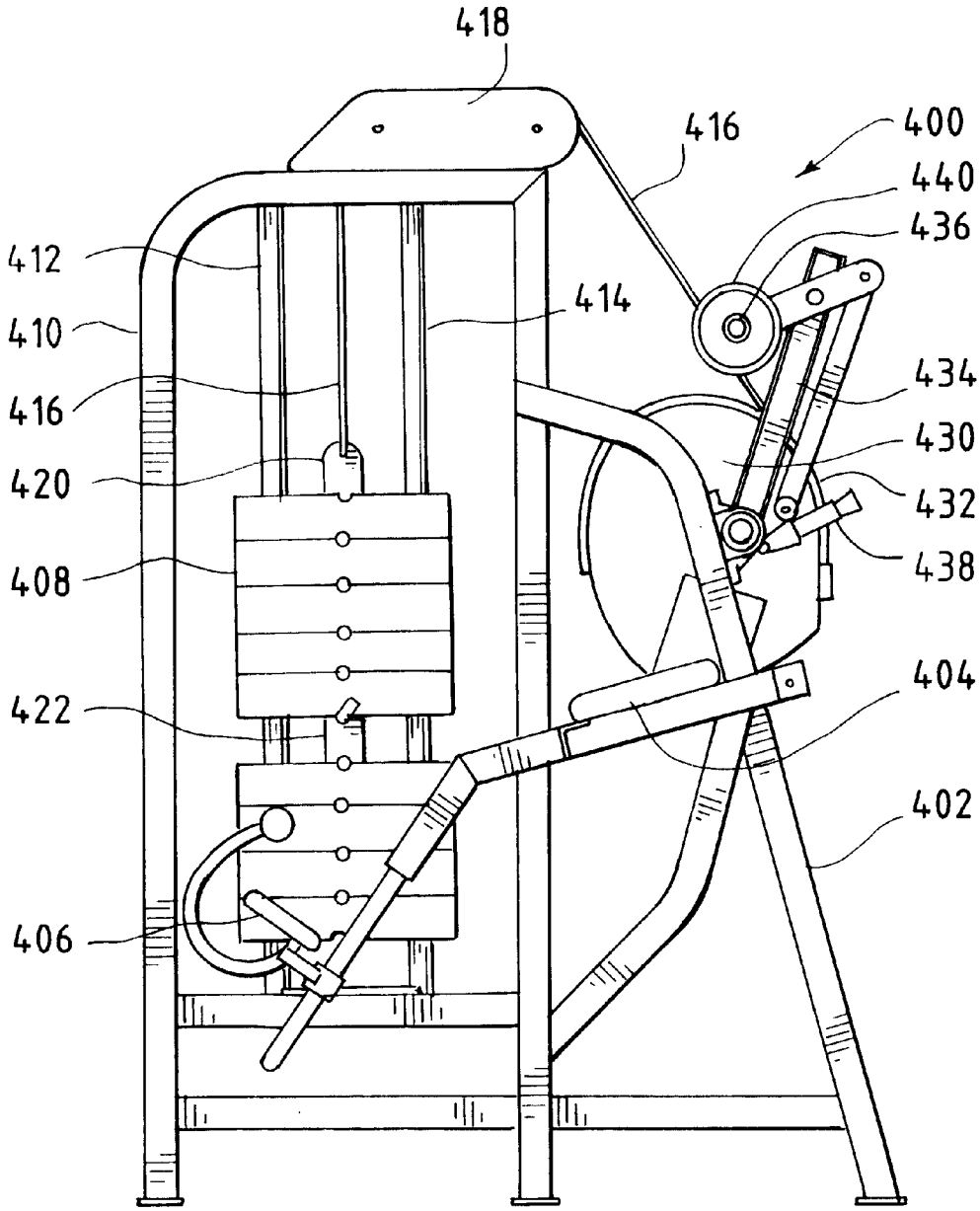
FIG. 8 is a side view of a lower back extension machine using the selector mechanism of the present invention for a back pad.

The adjustment mechanism described above may be used in conjunction with any pads which require adjustment relative to a user. FIG. 8 shows a side view of a lower back extension exercise machine 400 which is designed to strengthen lower back muscles. The exercise machine 400 has a rigid frame 402 which holds a spring-loaded seat 404.

A foot rest 406 is located relative to the seat 404 and may be adjusted to a user's specific height. A series of weights 408 is suspended by a vertical frame 410. The weights 408 are threaded on two vertical guide rods 412 and 414. A cable 416 is suspended from a pulley guard 418 and is connected via a cable termination fitting 420 to a weight selector rod 422. A user may select the number of weights 408 which are pulled by the cable 416 by inserting a pin between the weights 408 and into the weight selector rod 422.

The other end of the cable 416 is threaded through the pulley guard 418 and attached to a rotating cam 430. The cam 430 has a groove 432 to guide the cable 414 and is rotated by an attached user arm 434. The user arm 434 is attached to a perpendicular rod 436 via a position selector mechanism 438. A cylindrical back pad 440 is mounted on the perpendicular rod 436. The location of the cylindrical back pad 440 relative to the user arm 434 may be adjusted by the position selector mechanism 438 which is identical to the position selector mechanism 84 shown in FIG. 3.

The user adjusts the position of the back pad 440 using the selector mechanism 438 as explained above. A user sits on the seat 404 and locks his or her feet on the foot rest 406. The user leans back to contact his or her back on the back pad 440. The user then leans back pushing the back pad 440, which causes the user arm 434 to rotate the cam 430 thus pulling the weights 408.

It will be apparent to those skilled in the art that various modifications and variations can be made in the method and system of the present invention without departing from the spirit or scope of the invention. Thus, the present invention is not limited by the foregoing descriptions but is intended to cover all modifications and variations that come within the scope of the spirit of the invention and the claims that follow.

What is claimed is:

1. An adjustment mechanism for use with a user arm in an exercise machine, the user arm designed to strengthen the muscle of a user by moving the user arm, the adjustment mechanism comprising:

a selector hub mounted on one end of the user arm;

a selector rotatably connected to the selector hub, the selector being capable of being locked in position relative to the selector hub;

a linkage bar having one end pivotably mounted to the selector;

a support linkage bar being rotatably mounted to the opposite end of the user arm, the support linkage bar having one end rotatably coupled to the opposite end of the linkage bar; and a perpendicular rod coupled to the opposite end of the support linkage bar, the perpendicular rod being fixed in position relative to the user arm when the selector is locked in position relative to the selector hub.

2. The adjustment mechanism of claim 1 wherein the selector hub has an arcuate surface having a plurality of holes; and wherein the selector includes a pull pin assembly rotatably positionable around the selector hub, the pull pin assembly including a pin which may be inserted in the plurality of holes to lock the selector in a fixed position.

3. The adjustment mechanism of claim 2 wherein the pull pin assembly further includes a fork having two arms which are rotatably joined to the selector hub, a cylinder mounted on the fork, a knob, and wherein the pin is connected to the knob and is moveable within the cylinder.

4. The adjustment mechanism of claim 1 wherein the selector is a friction clamp.

5. The adjustment mechanism of claim 1 wherein the selector is a screw clamp.

6. The adjustment mechanism of claim 1 wherein the selector hub has an arcuate surface having a plurality of slots; and wherein the selector includes a moveable plate which may be inserted in one of the plurality of slots to lock the selector in a fixed position.

7. The adjustment mechanism of claim 1 further comprising a pad having a user contact surface mounted on the perpendicular rod.

8. The adjustment mechanism of claim 7 wherein the pad is a cylindrical shape.

9. The mechanism of claim 8 wherein the pad is made of closed cell foam.

10. The mechanism of claim 1 further comprising a second support linkage bar being rotatably mounted to the opposite end of the user arm and opposite the support linkage bar, the second support linkage bar having one end rotatably coupled to the opposite end of the linkage bar and the perpendicular rod coupled to the opposite end of the second support linkage bar.

11. An exercise machine for conditioning a user's muscles, the machine comprising:

a frame providing a stable support for a user's body;

a user arm moveably coupled to the frame;

a cable having one end coupled to the user arm;

a weight system coupled to the opposite end of the cable, wherein moving the user arm causes the weight system to move;

a selector hub mounted on the user arm;

a selector mechanism rotatably positionable about the selector hub, the selector being capable of being locked in a position relative to the selector hub;

a linkage bar having one end pivotably mounted to the selector mechanism;

a support linkage bar being rotatably mounted to the opposite end of the user arm, the support linkage bar having one end rotatably coupled to the opposite end of the linkage bar; and a perpendicular rod coupled to the opposite end of the support linkage bar, the perpendicular rod being fixed in position relative to the user arm when the selector mechanism is locked in a position relative to the selector hub.

12. The exercise machine of claim 11 further comprising:

a pulley mounted on the frame, the pulley located over the weight system; and a rotatable cam coupled to the frame, wherein the user arm is connected to the cam and the end of the cable is connected to the rotatable cam and guided over the pulley and wherein the weight system is tensioning the rotatable cam in one position.

13. The exercise machine of claim 12 wherein the weight system has a plurality of weights which may be attached to a weight selection rod coupled to the opposite end of the cable for varying the weight tensioned by the cam.

14. The exercise machine of claim 11 wherein the selector hub has an arcuate surface having a plurality of holes and the selector includes a pull pin assembly rotatably positionable around the selector hub, the pull pin assembly including a pin which may be inserted in the plurality of holes to lock the pin assembly in a fixed position.

15. The exercise machine of claim 11 further comprising a pad having a user contact surface mounted on the perpendicular rod.

16. The exercise machine of claim 15 wherein the pad is a cylindrical shape.

17. The exercise machine of claim 16 wherein the pad is a calf pad.

18. The exercise machine of claim 16 wherein the pad is an ankle pad.

19. The exercise machine of claim 16 wherein the pad is a back pad.

20. An exercise machine for conditioning a user's muscles, the machine comprising:

a frame providing a stable support for a user's body;

a rotatable cam coupled to the frame;

a cable having one end connected to the rotatable cam and guided over a pulley mounted on the frame, the cable having an opposite end coupled to a weight system, the weight system tensioning the rotatable cam in one position;

a user arm having one end coupled to the rotatable cam;

a selector hub mounted on the user arm, the selector hub having an arcuate surface having a plurality of holes;

a pull pin assembly rotatably positionable around the selector hub, the pull pin assembly including a pin which may be inserted in the plurality of holes to lock the pin assembly in a fixed position;

a linkage bar having one end pivotably mounted to the pull pin assembly;

a support linkage bar being rotatably mounted to the opposite end of the user arm, the support linkage bar having one end rotatably coupled to the opposite end of the linkage bar; and a perpendicular rod coupled to the opposite end of the support linkage bar, the perpendicular rod being fixed in position relative to the user arm when the pin is inserted in one of the plurality of holes.

* * * * *